United States Patent [19]

Mechem et al.

[11] Patent Number: 4,993,127

[45] Date of Patent: Feb. 19, 1991

[54] LOCKING ATTACHMENT FOR GUITAR STRAPS AND THE LIKE

[75] Inventors: Larry J. Mechem; Larry J. Mechem, Jr.; G. Michael Fox, all of Anderson, Ind.; James V. Weston, Fountain Run, Ky.

[73] Assignee: Standtastic, Anderson, Ind.

[21] Appl. No.: 415,624

[22] Filed: Sep. 29, 1989

[51] Int. Cl.[5] ..... A41F 1/00; G10D 3/00

[52] U.S. Cl. ..... 24/701; 24/324; 24/453; 84/327

[58] Field of Search ..... 24/700, 701, 702, 697, 24/453, 289, 297, 324, 662; 84/327

[56] References Cited

U.S. PATENT DOCUMENTS

| | | | |
|---|---|---|---|
| D. 234,204 | 1/1975 | Miller et al. | 24/543 |
| 927,323 | 7/1909 | Bryant | 24/701 |
| 1,754,200 | 4/1930 | Janes | 24/324 |
| 2,039,110 | 4/1936 | Patchen | 24/701 |
| 2,422,693 | 6/1947 | McArthur | 24/701 |
| 3,306,483 | 2/1967 | Bellafiore | 24/302 |
| 4,188,851 | 2/1980 | Wolf | 84/327 |
| 4,653,422 | 3/1987 | Allen | 24/300 |
| 4,698,882 | 10/1987 | Lang | 24/289 |

FOREIGN PATENT DOCUMENTS

| | | | |
|---|---|---|---|
| 1302862 | 1/1973 | United Kingdom | 24/701 |
| 2182092 | 5/1987 | United Kingdom | 84/327 |

*Primary Examiner*—Victor N. Sakran

*Attorney, Agent, or Firm*—Woodard, Emhardt, Naughton, Moriarty & McNett

[57] ABSTRACT

A device for locking a guitar strap to a guitar has a slotted base with one slot for receiving a guitar strap through it, and a second slot for mounting to the strap peg on the guitar. The second slot is keyhold shaped and has an entry portion and a retaining portion, the entry portion being large enough to receive the head of the peg, and the retaining portion being narrow enough to prevent the peg head from passing through it. A slot blocking lid is hinged to the base and pivotable about the hinge to close so that the entry portion of the slot can be blocked when the peg has been received in the retaining portion of the slot. A retainer strap is secured to the base at one end remote from the hinge, and extends through a slot in the lid, also remote from the hinge, and fastened by a snap fastener adjacent the hinge to hold the slot blocker lid in locking position until the retainer strap is intentionally released. The arrangement of the retainer strap is such that it has a very large mechanical advantage impeding the inadvertent release thereof.

5 Claims, 2 Drawing Sheets

LOCKING ATTACHMENT FOR GUITAR STRAPS AND THE LIKE

BACKGROUND OF THE INVENTION

This invention relates generally to apparatus for attaching straps to strap-supported devices, and more particularly to a locking attachment device for connecting a strap to a guitar or other device.

Various means have been devised for attaching straps to items to be supported by straps. They range from a simple shot in the strap, to a metal connector. There has remained a need for a way to keep a guitar strap securely connected to the guitar regardless of how the guitar is handled or oriented, but which is readily removable when desired.

SUMMARY OF THE INVENTION

Described briefly, according to a typical embodiment of the present invention, a generally planar plastic member is provided with one slot therein for receiving a strap through it, and a second slot for mounting to an anchor post ("strap peg" on a guitar). The second slot has an entry portion and a retaining portion, the entry portion being large enough to receive the head of the anchor post, and the retaining portion being narrow enough to prevent the head from passing through it. A slot blocking member is provided and hinged to the base so that the entry portion of the slot can be blocked when the post has been received in the retaining portion of the slot. A retainer strap is secured at one end of the base and passed through a portion of the blocking member and fastened by a snap fastener to hold the blocking member in blocking position until the retainer strap si intentionally released. The orientation of the retainer strap is such that it has a very large mechanical advantage maintaining the blocking member in blocking position and impeding the inadvertent release thereof.

DESCRIPTION OF THE PREFERRED EMBODIMENT

Figure 1:
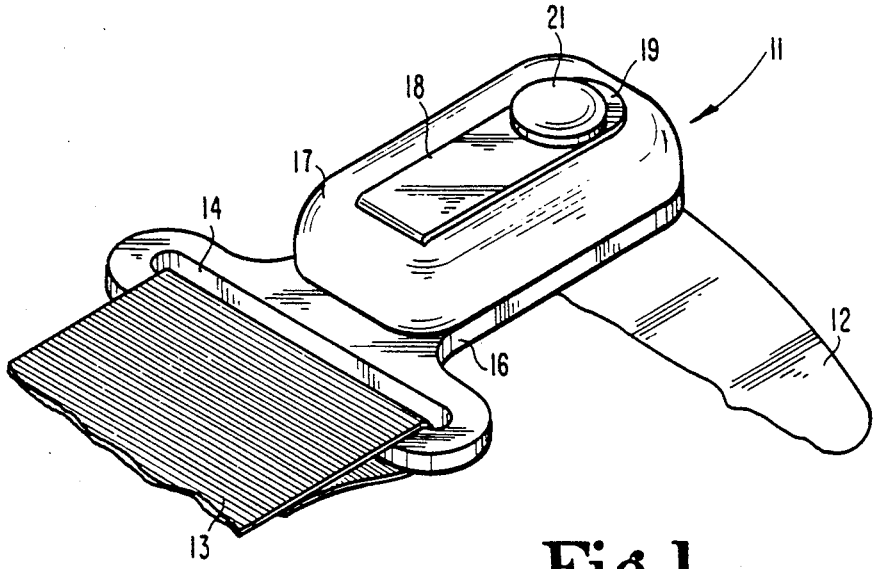
FIG. 1 is a pictorial view of a guitar strap lock according to a typical embodiment of the present invention.
Figure 2:
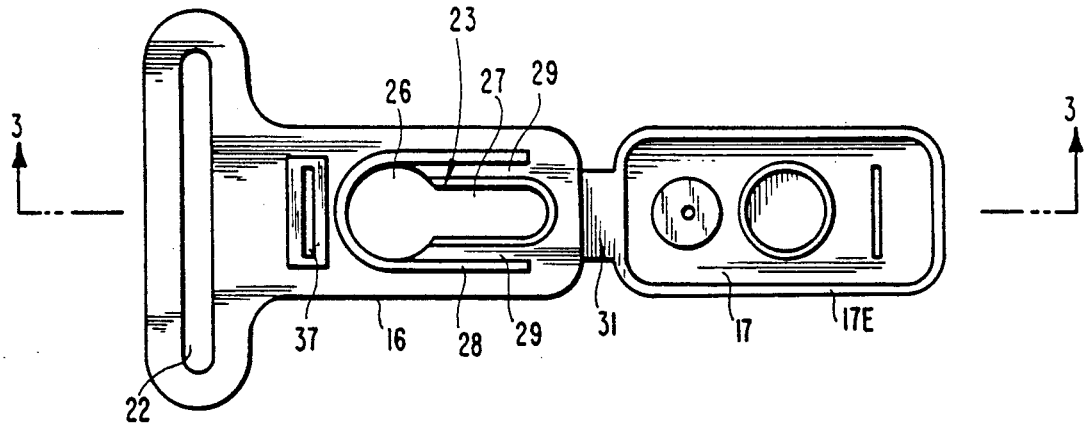
FIG. 2 is a top plan view of the base and cover portion.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, the guitar strap lock assembly 11 is shown fastened to an anchor post (not shown) fixed in the guitar 12. The guitar strap 13 is received in a slot 14 in the base 126 of the lock assembly. The cover 17 of the lock assembly is retained in place by the retainer strap 18 (not the guitar strap), having a distal end portion 19 secured by a snap fastener assembly having a button 21 at the end of strap 18.

Referring now to the other figures of drawing, the base 16 and cover 17 are made of one single homogeneous piece of material, typically a nylon, with the base generally flat and the cover somewhat shell-shaped having a planar edge 17E. The base is generally elongate and T-shaped, having a slot 22 therein to receive the guitar strap, and a keyhole shaped slot 23 to receive the anchor post 24 (FIGS. 5 and 6) which is fixed to the guitar 12, and usually referred to as the "strap peg". Slot 23 has a wide, circular portion 26 and a narrow elongate portion 27. The wide portion is large enough for entry of the anchor post head 24H. The narrow portion 27 is wide enough to receive the anchor post stem 24S but too narrow for passage of the anchor post head through it. A U-shaped wall 28 integral with the base 26 and upstanding from it, extends around and is a vertical extension of a portion of the circular wall of the entry portion 26 of the slot 23. The two arms of the wall 28 are parallel to the slot portion 27 and spaced from it, whereby there is a support surface 29 on each side of the slot 27 to retain the head of the anchor post when the lock assembly is secured to the anchor post.

Figure 3:
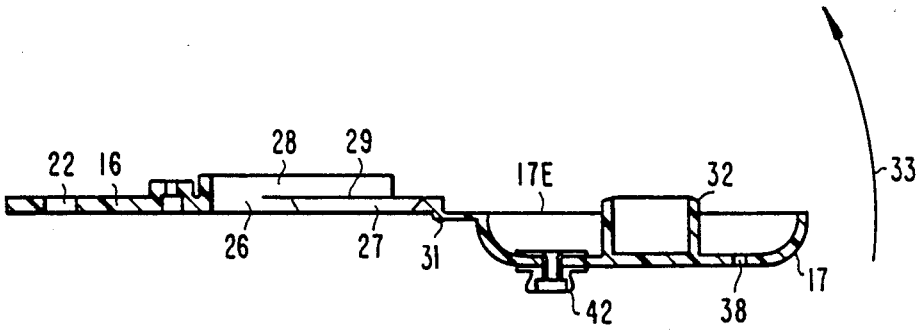
FIG. 3 is a longitudinal section taken through FIG. 2 at the line 3—3 in FIG. 2 and viewed in the direction of the arrows.
Figure 4:
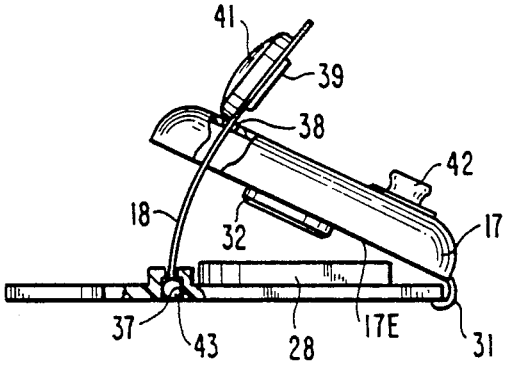
FIG. 4 is a side elevational view of the base and cover portion, with a retainer strap installed, the view shown partially in section to illustrate the manner of mounting of the retainer strap to it.
Figure 6:
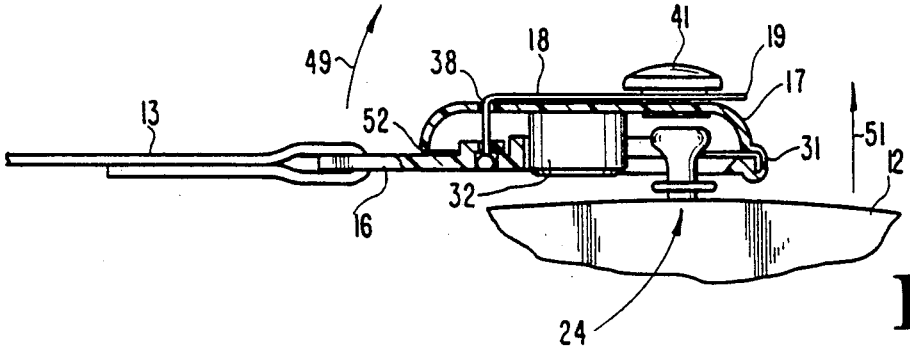
FIG. 6 is a view in section showing the lock secured to the strap peg of the guitar.
Figure 7:
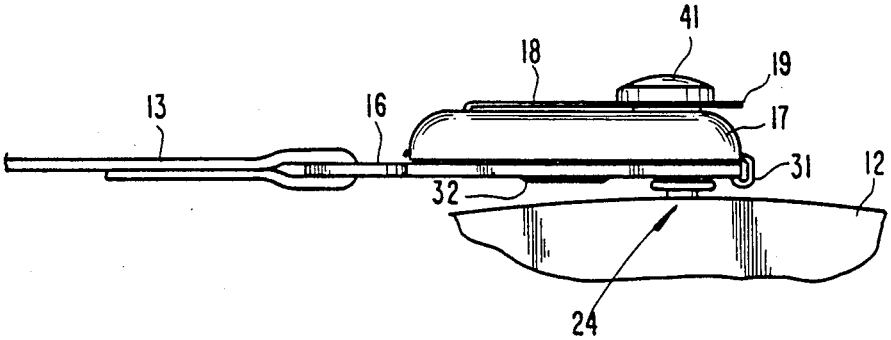
FIG. 7 is an elevational view showing the strap lock secured to the strap peg of the guitar.

The cover 17 is connected by the integral living hinge 31 to the base portion of the assembly and includes a cylindrical wall 32 which, when the cover is swung upwardly in the direction of the arrow 33 (FIG. 3) to the position shown in FIG. 4, approaches the entry portion 26 of the slot 23. In fact, the cylindrical wall 32 is sized such as to be fittingly received in the entry portion 26 of slot 23 as is shown in FIG. 6. When in that position, as can be best seen in FIG. 6, the wall 32 serves as a blocker to obstruct the end of the slot portion 27 and to prevent exit of the anchor post from the slot.

The retainer strap 18, which may be made of polyvinylchloride material, is received in a slot 37 in the base 16 and through a slot 38 in the cover 17. Strap 18 has the socket portion 39 of a standard snap fastener assembly mounted thereto, with the head button 41 on the upper face of the strap 18 near its distal end 19. The plug end 42 of the snap fastener assembly is mounted to the top of the cover 17. The lower end of the strap 18 is enlarged as at 43 so it is larger than the slot 37 and thereby prevented from pulling up through slot 37. Heat welding or adhesive welding may also be used at that point if desired.

Figure 5:
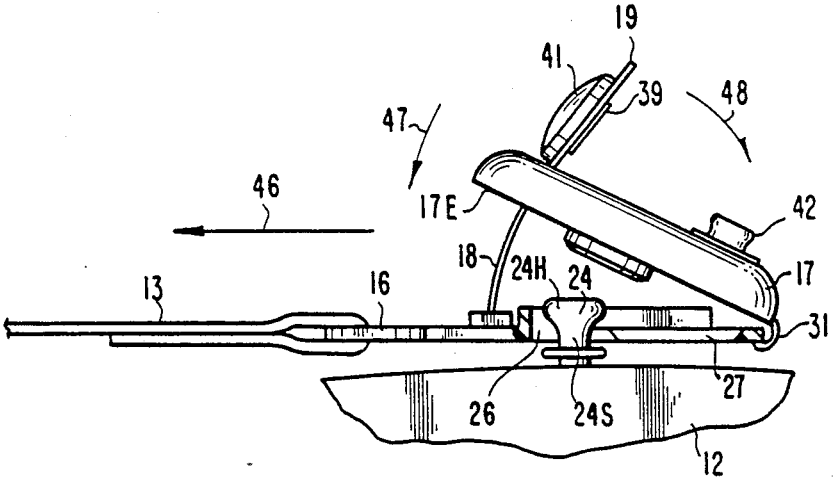
FIG. 5 is a view similar to FIG. 4 but showing the device mounted to the strap peg on a guitar at the initial mounting step where the strap peg has just entered the receiver portion of the locking slot.

In the use of the invention, when the guitar strap 13 is to be attached to the guitar, the cover 17 is in the open (unlocking) position as shown in FIGS. 4 and 5. When in that position, the base 16 of the lock assembly can be placed down over the head 24H of the strap peg 24 so that the head 24H is easily received through the entry portion 26 of the base. Then the strap 13 may be pulled in the direction of the arrow 46 (FIG. 5) so the stem 24S moves into the narrow portion 27 of the retainer slot. Then the cover 17 can be pushed down in the direction of arrow 47 so that the blocker cylinder 32 is received in the circular entry portion 26 of the slot 23, whereupon the blocker is in the locking position and prevents removal of the strap peg out of the slot 27. Then the retainer strap 18 is pushed or pulled over in the direction of arrow 48 and the socket portion 39 of the fastener assembly is pushed onto the plug portion 42 thereof by pushing down on the button 41, whereupon the fastener assembly snaps together. When in this condition, the retainer strap 18 is now snugly engaging the top of the cover 17 from the slot 38 toward the snap fastener assembly. Therefore, any tendency of the cover to open in the clockwise direction of arrow 49 in FIG. 6 is resisted quite well by the strap 18 at the slot 38 where the strap has a very high mechanical advantage with respect to the location of the cover hinge 31. The location of the snap fastener assembly 39, 42 close to the cover hinge 31, and the fact that part of the snap fastener assembly is mounted at the cover, essentially eliminates any opening force in the direction of arrow 51 on the fastener assembly, even if a force in that direction would be applied at the swinging end 52 of the cover.

The close fit of the blocker cylinder 32 in the cylindrical slot portion 26 and within that portion of wall 28, prevents any side motion of the cover relative to the base, and thus avoids any tearing or shearing type action on the strap 18 or the hinge 31. The provision of the walls 28 extending through most of the length of the slot 27 helps guide the cover during closure. In some cases, depending on anchor post configuration and size, walls 28 may also minimize wear on the slot 27, as the walls 28 may engage the periphery of the head of the anchor post and thus control transverse movement of the lock assembly relative to the anchor post before there would be any undue wear of the slot 27 on the anchor post stem and which, over a period of time, might otherwise result in sufficient widening of the slot to enable the head of the anchor post to pull through it.

In view of the foregoing, according to the unusual construction of this guitar strap lock assembly, it provides a very reliable and durable lock for such straps for use with guitars, other musical instruments, and other devices or loads which employ an anchor post of the general type shown in FIGS. 5 and 6.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

We claim:

1. A strap lock comprising:

a base having first and second slots therein, said first slot being oriented and configured to receive a strap through it, and said second slot being oriented and configured to receive an anchor post;

a blocker associated with said base and operable between an unlocking position and a locking position, said blocker being positionable in said locking position to limit movement of an anchor post in said second slot;

a blocker retainer on the base and movable to a retaining position to hold said blocker in said locking position;

said base and blocker being made of one material in one piece with an integral living hinge connecting the base to the blocker;

said blocker including a blocking wall therein movable into position blocking a portion of the second slot when said blocker is in said locking position;

said blocker retainer being a retainer strap having two ends, with one end anchored in said base and the other end having the first part of a snap fastener thereon, and a second part of the snap fastener being fixed on said blocker, the location of said snap fastener parts being such that when said blocker is in said locking position, and said retainer strap is in said retaining position, said first and second parts of said snap fastener are connectable and oriented in a position relative to said blocker and said base such that said blocker has no effective fastener-opening leverage on said retainer strap.

2. The strap lock of claim 1 and wherein:

said blocker includes a shell sized to cover said second slot when said blocker is in the locking position, to thereby cover an anchor post when in said second slot, said shell having a third slot receiving said retainer strap through it adjacent the one end of the retainer strap when the blocker is in the locking position.

3. The strap lock of claim 2 and wherein:

said shell has a substantially perimetrical edge thereof lying substantially in a single plane, and said base has a top surface that is substantially planar, the locking position of said shell placing said shell edge immediately adjacent the top surface of said base.

4. A guitar strap lock system comprising:

a guitar strap having a loop at an end thereof;

a guitar having a strap anchor post thereon, said anchor post having a stem with a head at the distal end of the stem;

a base having first and second slots therein, said first slot being oriented and configured to receive a strap through it and receiving said strap loop through it, and said second slot being oriented and configured to receive an anchor post and receiving said anchor post stem therein;

a slot blocker associated with said base and operable between an unlocking position and a locking position, said blocker being positionable in said locking position to limit movement of said anchor post in said second slot;

a blocker retainer operable, when actuated, to hold said blocker in said locking position;

said blocker retainer being a retainer strap having two ends, with one end anchored in said base and the other end having the first part of a snap fastener thereon, and a second part of the snap fastener being fixed on said blocker, the location of said snap fastener parts being such that when said blocker is in said locking position, and said retainer strap is in said retaining position, said first and second parts of said snap fastener are connectable and oriented in a position relative to said blocker and said base such that said blocker has no effective fastener-opening leverage on said retainer strap.

5. A guitar strap lock system comprising:

a guitar strap having a loop at an end thereof;

a guitar having a strap anchor post thereon, said anchor post having a stem with a head at the distal end of the stem;

a base having first and second slots therein, sad first slot being oriented and configured to receive a strap through it and receiving said strap loop through it, and said second slot being oriented and configured to receive an anchor post and receiving said anchor post stem therein;

a slot blocker associated with said base and operable between an unlocking position and a locking position, said blocker being positionable in said locking position to limit movement of said anchor post in said second slot;

a blocker retainer operable, when actuated, to hold said blocker in said locking position;

said blocker having hinge mans and one end attached to said base at said hinge means and an opposite end swingable about the hinge means to a position adjacent said base when said blocker is in said locking position;

said blocker retainer being a retainer strap having two ends, with one end anchored in said base remote from said hinge means and the other end having the first part of fastener means thereon; and a second part of the fastener means being fixed on said blocker adjacent said hinge means;

said blocker having a guide thereon adjacent the swinging end thereof and receiving a portion of the retainer strap thereon;

whereby said retainer strap engages the swinging end of the blocker when the blocker is in the locking position such that when said blocker is in said locking position, and said retainer strap is holding said blocker in said locking position, the location of engagement of the strap to the swinging end of the blocker is remote from the hinge means and has a large mechanical advantage in a direction perpendicular to a radius from the hinge means to the swinging end of the blocker, to retain said blocker secure against swinging motion in unlocking direction.

* * * * *